US005892504A

United States Patent [19]

Knapp

[11] Patent Number: 5,892,504

[45] Date of Patent: Apr. 6, 1999

[54] MATRIX DISPLAY DEVICE AND ITS METHOD OF OPERATION

[75] Inventor: Alan G. Knapp, Crawley, England

[73] Assignee: U.S. Philips Corporation, New York, N.Y.

[21] Appl. No.: 187,364

[22] Filed: Jan. 26, 1994

Related U.S. Application Data

[63] Continuation of Ser. No. 916,451, Jul. 17, 1992, abandoned.

[30] Foreign Application Priority Data

Jul. 17, 1991 [GB] United Kingdom ..... 9115402

[51] Int. Cl.[6] ..... G09G 3/36

[52] U.S. Cl. ..... 345/204; 345/210; 345/95; 345/91; 345/92

[58] Field of Search ..... 345/204, 205, 345/206, 87, 90, 91, 92, 100, 904; 359/55, 59; 178/18, 19; 349/41–54

[56] References Cited

U.S. PATENT DOCUMENTS

| | | | |
|---|---|---|---|
| 4,443,741 | 4/1984 | Tanaka et al. | 345/78 |
| 4,586,039 | 4/1986 | Nonomura et al. | 340/719 |
| 5,172,104 | 12/1992 | Tanigaki et al. | 345/84 |
| 5,220,315 | 6/1993 | Clerc | 340/784 |
| 5,229,761 | 7/1993 | Fuse | 359/55 |

FOREIGN PATENT DOCUMENTS

| | | | |
|---|---|---|---|
| 0185995 | 12/1985 | European Pat. Off. . | |
| 0299546 | 6/1988 | European Pat. Off. . | |
| 0362939 | 9/1989 | European Pat. Off. . | |
| 0360523 | 3/1990 | European Pat. Off. . | |
| 0374372 | 6/1990 | European Pat. Off. . | |
| 0376233 | 7/1990 | European Pat. Off. . | |
| 0362939 | 11/1990 | European Pat. Off. | 340/784 |
| 0428250 | 5/1991 | European Pat. Off. | 340/784 |
| 2-160283 | 6/1990 | Japan | 340/784 |
| 3146992 | 6/1991 | Japan . | |
| 3-200214 | 9/1991 | Japan | 340/784 |
| 2129182 | 5/1984 | United Kingdom . | |
| 2147135 | 5/1985 | United Kingdom . | |

*Primary Examiner*—Lun-Yi Lao
*Attorney, Agent, or Firm*—Robert J. Kraus

[57] ABSTRACT

A matrix display device comprising a row and column array of display elements (14), e.g. LC display elements, each of which is connected in series with a two terminal non-linear device (15), such as a MIM, between associated row and column address conductors (16,17) and drive means (20,22, 25) for applying drive voltages to the picture elements comprising a scanning signal circuit (20) and a data signal circuit (22) for applying selection signals and data signals respectively to the sets of address conductors, in which a sensing circuit (40) provides a control signal ($V_1$) indicative of current flowing in one, or more, address conductor (16) of one set during the application of selection signals to that conductor which determines the drive voltages applied to the picture elements, preferably by adjustment of the selection signal level, so as to compensate for changes over time in the threshold characteristics of the non-linear devices. Four or five level scanning signal drive schemes may be used. Such compensation may be effected periodically or continually in operation of the display device.

16 Claims, 4 Drawing Sheets

MATRIX DISPLAY DEVICE AND ITS METHOD OF OPERATION

This is a continuation of prior application Ser. No. 07/916,451, filed on Jul. 17, 1992, now abandoned.

BACKGROUND OF THE INVENTION

This invention relates to a matrix display device comprising sets of row and column address conductors, a row and column array of picture elements operable to produce a display, each of which comprises an electro-optic display element connected in series with a two terminal non-linear device exhibiting a threshold characteristic between a row conductor and a column conductor, and picture element drive means connected to the sets of address conductors for applying drive voltages to the picture elements comprising a scanning signal drive circuit for applying selection signals to the conductors of one set and a data signal drive circuit for applying data signals to the conductors of the other set. The invention relates also to a method of operating such a display device.

Display devices of this kind are suitable for displaying alpha-numeric or video information using passive electro-optical display media such as liquid crystal material, electrophoretic suspensions or electrochromic materials. Examples of such display devices, using liquid crystal material, are described in GB-A-2129182, EP-A-0185995, and GB-A-2147135. The two terminal non-linear devices can be of various forms, such as diode rings, back to back diodes, MIMs, etc., which are bidirectional. The polarity of the drive voltages applied to the picture elements can then conveniently be inverted periodically, typically in successive field periods, in order to prevent degradation of the electro-optic display material and improve display quality. The picture elements are addressed by sequentially applying a selection voltage signal to each one of the first set of address conductors, usually the row conductors, and data, for example video, signals to the other set of address conductors to set the display elements to a desired display condition which is maintained until they are again selected.

For acceptable quality of display it is important that the non-linear devices of the matrix array demonstrate substantially similar threshold and I-V characteristics in operation so that the same drive voltages applied to any picture element in the array produce substantially identical visual results, for example in the case of a liquid crystal display device, as regards picture element transmission levels. Differences in the threshold or turn-on point of the non-linear devices can appear directly across the electro-optical material producing different display effects from picture elements addressed with the same drive voltages.

Serious problems can arise if the threshold level of the non-linear devices changes over a period of time, for example through ageing effects. The consequential change in display element voltages not only leads to inferior display quality but, depending on the drive scheme employed, can cause an image storage problem and also degradation of the LC material.

In the aforementioned GB-A-2129182 a drive scheme is described which involves a four level row drive in which the scanning signal applied to a row conductor consist of first, selection, voltage level for a selection interval of fixed duration followed by a second, hold, voltage level of less value but of the same polarity as the selection level and which is maintained for at least a major portion of the time which elapses until the row conductor is next addressed with the selection voltage level. The polarity of the selection and hold levels is inverted for successive field periods. It is said that by using this method non-linear devices having a comparatively low threshold voltage would be sufficient allowing relatively low drive voltages. There is also described briefly in this specification a reference voltage setting circuit which is used to adjust the selection and hold voltages applied to the picture elements in accordance with changes in the threshold voltage level of a non-linear element caused by variations in operating temperatures in use of the display device. This circuit uses a reference non-linear element, namely a diode element, one side of which is connected to ground, and operates to compare the threshold voltage of the reference element with reference potentials comprising a predetermined threshold voltage level. This is achieved by sensing the voltage across the reference element.

SUMMARY OF THE INVENTION

It is an object of the present invention to provide a display device of the kind described in the opening paragraph in which compensation is effected for changes in the characteristics of the non-linear devices reliably and accurately so as to maintain display performance in operation of the display device over a period of time.

According to one aspect of the present invention a matrix display device as described in the opening paragraph is characterised in that the drive means includes a sensing circuit which is arranged to provide a control signal indicative of electrical current flowing in at least one address conductor of the one set during the application of selection signals to that address conductor, and a voltage control circuit to which the control signal is supplied for providing an output determining the drive voltages applied by the drive means to the picture elements in accordance with the value of the control signal.

According to another aspect of the present invention, a method of operating a matrix display device of the kind described in the opening paragraph is characterised by the steps of deriving a control signal indicative of the electrical current flowing in at least one address conductor of the one set during the application of selection signals to that address conductor and controlling the drive voltages applied by the drive means to the picture elements in accordance with the value of the control signal.

By sensing the electrical current in the one or more address conductors and using this information to control the picture element drive voltages compensation for changes in the threshold characteristics of the non-linear devices of the array can be effected in a simple and convenient manner. Importantly, it will be appreciated that the approach to compensation used in the invention involves sensing the behaviour of the non-linear devices associated with picture elements, as compared with the scheme for compensating for the effects of temperature changes described in GB-A-2129182 which involves a dedicated reference non-linear element. The latter approach may be adequate for compensating for temperature change effects, but the reference element cannot be expected to reflect accurately changes in the behaviour of the actual non-linear devices controlling the display elements since the behaviour of the reference element is not necessarily indicative of the behaviour of the non-linear devices of the picture elements. Of particular importance in this respect are the ageing characteristics of the non-linear devices. The operational characteristics of a non-linear device can change over a period of operation of the display device and for many devices, for example SiN MIMs, the extent of this change is dependent to some extent on the way in which it is used and driven. The reference element of the known scheme is not driven in the same way as the picture element non-linear devices but is simply connected continuously between a fixed reference potential and ground. Moreover, the reference element in this known scheme comprises a single diode element rather than a diode ring as used for the non-linear devices of the picture elements. In the present invention, however, compensation for a change in threshold levels is not made dependent solely on a single non-linear element but instead is conditional on the behaviour of a plurality of non-linear devices comprising at least the non-linear devices associated with a row of picture elements. Furthermore, the devices are part of the actual display and hence are driven in a way typical of all picture elements. Accordingly, a more faithful indication of changes in the behavioural characteristics generally of the non-linear devices is obtained than is possible with the known scheme which is reliant on the behaviour of the single diode element.

The voltage control circuit may be arranged to adjust the value of the data signals in accordance with the control signal so as to compensate for sensed changes in the behaviour of the non-linear devices. Preferably, however, the voltage control circuit is arranged to determine the level of the selection signals in accordance with the control signal. In addition to being convenient to implement, the adjustment of the level of the selection signals so as to compensate for sensed changes in non-linear device characteristics avoids the possibility of increased leakage currents occuring during the non-selection periods that can degrade aspects of display performance such as contrast which may result if the data signals are adjusted.

The level of the selection signals is preferably adjusted in accordance with the difference between the control signal and a reference level.

The invention is particularly beneficial for display devices in which the non-linear devices comprise MIMs. The non-linear devices may, however, comprise other forms of bidirectional devices such as diode rings or back to back diodes. The invention may also be used to advantage in display devices in which the non-linear devices comprise unidirectional devices such as pin or Schottky diodes, for example as described in EP-A-0299546 in which each display element is connected in series with a diode between respective row and column conductors.

The scanning signal drive circuit can be of a known kind, for example as described in GB-A-2129182, comprising a switching circuit having a plurality of stages, each of which is connected to a respective address conductor of the one set, and to which predetermined potentials are supplied via supply lines from a power supply which determine the potential levels of the scanning signals applied to the address conductors. In the drive scheme of GB-A-2129182, the scanning signals comprise selection and hold signals whose polarity is inverted in successive frames thereby making a four level drive scheme requiring the supply of four potentials to the scanning signal drive circuit. The display device of the present invention may be operated using such a drive scheme. Other drive schemes may, however, be employed. For example, a drive scheme of the kind described in EP-A-0362939 involving a five level scanning signal for picture elements having bidirectional non-linear devices which comprises a reset signal in addition to selection signals may be used. With this scheme five potential levels would be supplied to the scanning signal drive circuit. Another five level row scanning signal, comprising reset and selection signals having a similar sequence but in which the relative values of the levels differ slightly, is described in aforementioned EP-A-0299546 in relation to the drive scheme for a display device comprising unidirectional non-linear devices connected in series with the display elements between respective row and column address conductors.

For convenience, the sensing circuit of the drive means is preferably arranged to sense electrical current flowing in a supply line to the scanning signal drive circuit through which a potential determining the selection signal voltage level is supplied, and thus through which current is supplied to the address conductors during selection periods. In this way, a standard scanning signal drive circuit can be used, for example in IC form, without modification being necessary. In the case of the four level drive scheme, the supply line used can be either of the two selection signal level supply lines (one of each polarity) while for the five level drive scheme, according to EP-A-0362939 for example, the supply line used is that which supplies the charging current for the transition from the reset signal to the immediately succeeding selection signal level.

In addition to determining the level of the selection signal, the control signal obtained from the sensing circuit and indicative of the sensed current is preferably used to determine in similar manner other voltage levels present in the scanning signals, for example the level of the reset signal component in the five level drive scheme.

In a four level row drive scheme, the adjustment to the level of the selection signal component of the scanning signal, effected by the current sensing circuit acting in a feed back loop with the voltage control circuit, is preferably such as to maintain the amplitude of the display element voltage at a substantially constant level for a given data signal voltage despite any change which may occur to the threshold voltage level of the non-linear devices. In a five level row drive scheme, the adjustment to the level of the selection signal components, or the selection signal and other components, of the scanning signal is preferably determined so as to maintain the mean dc voltage of the display element at a substantially constant level for a given data signal voltage.

The operation of the sensing circuit and voltage control circuit to adjust the scanning signal may take place periodically or continually with operation of the display device. For example, these circuits may operate to provide scanning signal adjustment in response to electrical current in one address conductor or a plurality of address conductors in every field period or in selected field periods. Alternatively, they may be operated in a continuous manner in response to current in each address conductor of the one set in successive or selected fields. By sensing current in one supply line to the scanning signal drive circuit such alternatives, especially those involving a plurality of address conductors, are readily possible.

The current flowing in an address conductor of the one set, e.g. the row conductors, during a selection period is dependent to some extent on the value of the data signals applied to the conductors of the other set, e.g. the column conductors, at that time. In one embodiment of the invention, this dependency is taken into account in that the control signal supplied to the voltage control circuit comprises a voltage signal provided by the sensing means which varies in accordance with the sensed electrical current to which a correction factor is made in accordance with the levels of the data signals. To this end, the control signal may be obtained from the output of a subtractor circuit to one input of which the voltage signal generated in the sensing circuit is supplied and to the other input of which there is supplied a signal corresponding to the data signal supplied to the data signal drive circuit. Preferably, the signals are supplied to the inputs of the subtractor circuit via matched low pass filters. Thus in this embodiment, the value of the voltages appearing on the column address conductors during current sensing periods is determined and its contribution to the voltage signal indicative of current is removed. If the electrical current through only one address conductor is sensed then the data signal should be that applied to the row of picture elements concerned. In some cases the data signal may be delayed by one line period to ensure that the value used for correction is equivalent to that being used to drive the picture elements whose current is being sensed. This is desirable when the data signal drive circuit introduces a one line period delay between signals received and signals output to the conductors of the other set. If the electrical current through a plurality of conductors is being sensed in each field such a delay is not necessary.

In another embodiment, the data signal drive circuit may be arranged to supply a predetermined and fixed voltage to the column address conductors, rather than actual display data voltages, at selected periods during which current is sensed by the sensing circuit. In this case the selected periods may correspond for example to the first one or more display fields each time the display device is switched on. Thus, each time the display device is operated, an adjustment is made to the scanning signals if necessary depending on the non-linear device characteristics subsisting at that time.

In a further embodiment, a row of picture elements, for example at the top of the display and masked from view, may always be driven to a given level, for example mid-grey, and the operation of the sensing circuit arranged so as to sense only current supplied to this row of picture elements while it is being driven.

BRIEF DESCRIPTION OF THE DRAWING

A matrix display device, comprising a liquid crystal display device, and its method of operation, in accordance with the present invention will now be described, by way of example, with reference to the accompanying drawing figures, in which.

The same reference numerals are used throughout the Figures to indicate the same or similar parts.

DESCRIPTION OF THE PREFERRED EMBODIMENTS

Figure 1:
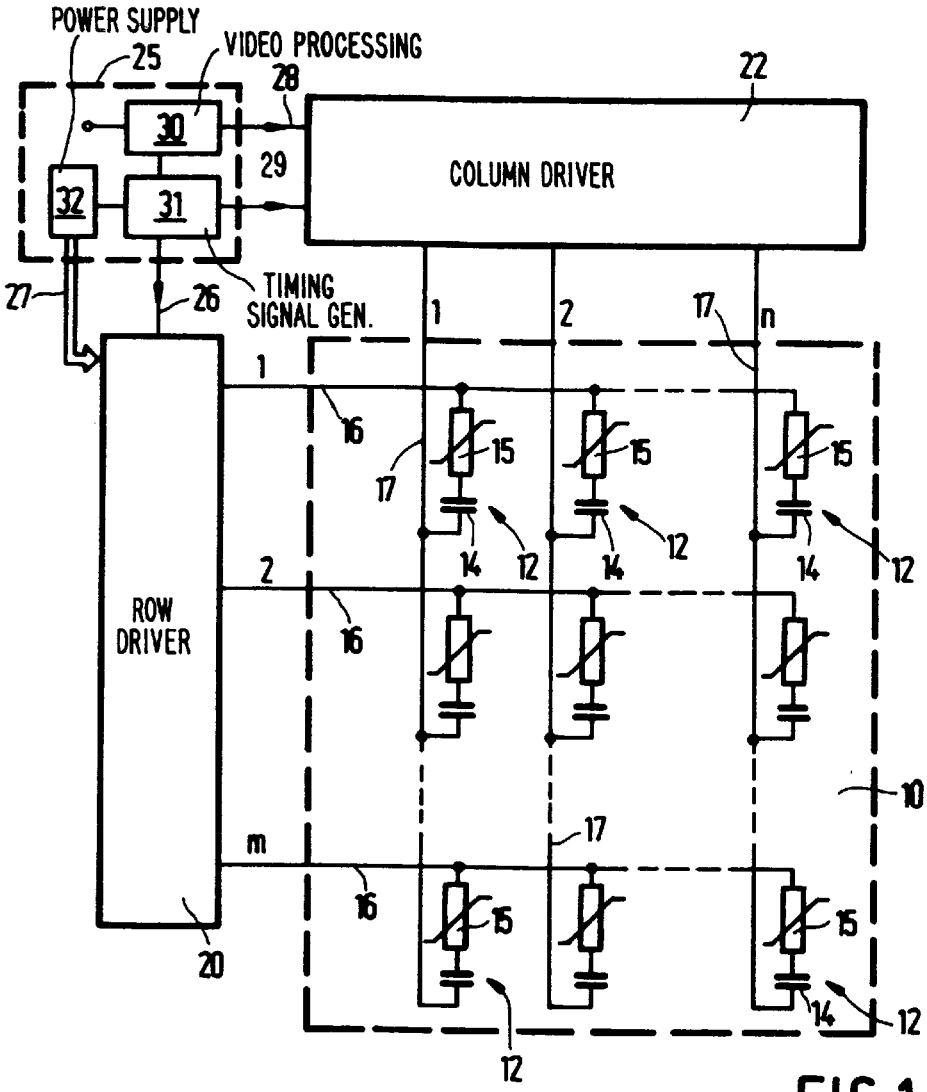
FIG. 1 is a simplified schematic block diagram of the display device.

Referring to FIG. 1, the display device is intended to display video information, for example TV pictures, and comprises an active matrix addressed liquid crystal display panel 10 consisting of m rows (1 to m) with n picture elements (1 to n) in each row. Each picture element 12 consists of a twisted nematic liquid crystal display element 14 connected electrically in series with a bidirectional non-linear resistance device 15 exhibiting a threshold characteristic and acting as a switching element between a row conductor 16 and a column conductor 17. The picture elements 12 are addressed via sets of row and column conductors 16 and 17 which are in the form of electrically conductive lines carried on respective opposing faces of two, spaced, glass supporting plates (not shown) also carrying the opposing electrodes of the liquid crystal display elements. The devices 15 are provided on the same plate as the set of row conductors.

The row conductors 16 serve as scanning electrodes and are addressed by a row driver circuit 20 which applies a scanning signal, comprising a selection signal component, to each row conductor 16 sequentially in turn. In synchronism with the scanning signals, data signals are applied to the column conductors 17 from a column conductor driver circuit 22 to produce the required display from the rows of picture elements associated with the row conductors 16 as they are scanned. In the case of a video, e.g. TV, display system these data signals comprise video information. The selection signal component determines a row selection period in which the optical transmissivity of the display elements 12 of the row are set to produce the required visible display effect according to the data signals present on the conductors 17 during this period. The individual display effects of the picture elements 12, addressed one row at a time, combine to build up a complete picture in one field, the picture elements being refreshed in a subsequent field. Using the transmission/voltage characteristics of a liquid crystal display element grey scale levels can be achieved. The voltage/conduction characteristic of the two-terminal non-linear devices 15 is bidirectional so that by reversing the polarity of the scanning and data signal voltages in, for example, successive fields a net dc bias across the display elements can be avoided.

Active matrix liquid crystal display devices employing two terminal non-linear resistance elements as switching elements in series with the display elements are generally well known and hence the foregoing description of the main features and general operation of the display device with regard to FIG. 1 has deliberately been kept brief for simplicity. For further information reference is invited to the aforementioned publications describing such types of display devices. The row and column driver circuits 20 and 22 are of conventional form, as described for example in GB-A-2129182, and are controlled by a timing and control circuit, generally referenced at 25, which comprises a video processing unit 30, a timing signal generation unit 31 and a power supply unit 32. The row drive circuit 20 comprises a digital shift circuit and switching circuit to which timing signals and voltages determining the scanning signal waveforms are applied from the circuit 25 through supply lines 26 and 27. The column driver circuit 22 comprises one or more shift register/sample and hold circuits and is supplied with video data signals along line 28 from the video processing unit 30 and derived from a video (TV signal containing picture and timing information. Timing signals are supplied to the circuit 22 along the line 29 in synchronism with row scanning to provide serial to parallel conversion appropriate to the row at a time addressing of the panel 10.

In this embodiment the non-linear devices 15 comprise MIMs. However other forms of bidirectional non-linear resistance devices exhibiting a threshold characteristic, for example diode rings, back to back diodes, or other diode structures may be used instead.

Row scanning is accomplished using a waveform comprising either four or five levels, as described for example in aforementioned GB-A-2129182 and EP-A-0362939 respectively to which reference is invited for further information and whose disclosures are incorporated herein by reference.

Figure 2A:
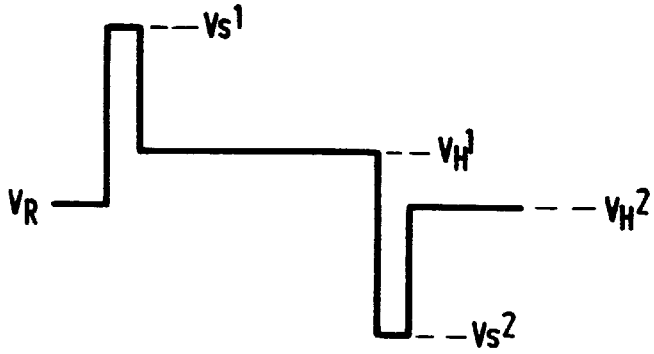
FIGS. 2*a* and 2*b* illustrate respectively the form of a scanning signal used in driving a known display device and the effect on the voltage of a liquid crystal display element of the device caused by a change in the characteristics of the element's associated non-linear device using this drive scheme.
Figure 2B:
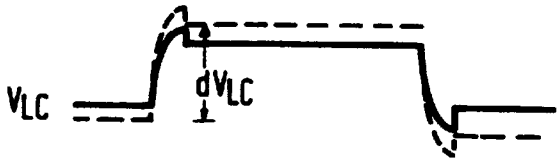

In known active matrix LC display devices using two terminal non-linear devices such as diodes or MIMs as the active elements, changes in the operating characteristics of the devices can produce changes in the display performance. If there is a change in the current through, and hence the voltage drop across, the non-linear device during the selection period when the device is conducting to charge the display element then there is a consequential change in the voltage appearing across the display element. The nature of this change depends on the drive scheme employed. In the case of a display device driven with a four level row drive scanning signal waveform, then a change in the threshold voltage level, i.e. the "on" level, of a non-linear device causes a change in the amplitude of the display element voltage and hence its transmission. FIG. 2(*a*) illustrates a typical scanning signal waveform, $V_R$, according to this drive scheme. This consists of a selection signal portion of magnitude $Vs^1$ and of duration corresponding to a row selection period which is followed immediately by a hold signal portion of lower voltage, $V_H^1$ but of like polarity for the remainder of the field period. These signal portions are inverted in successive fields so that in the next field the row conductor concerned is addressed with a selection signal $V_S^2$ followed by a hold signal $V_H^2$. FIG. 2*b* illustrates the voltage across a display element, $V_{LC}$, for a picture element whose non-linear device's threshold level changes, the solid and dotted lines representing the display element voltage in the case of respectively comparatively low and comparatively high threshold levels.

Figure 3A:
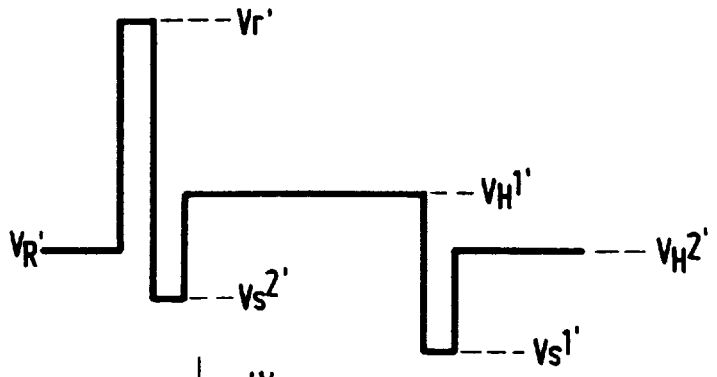
FIGS. 3*a* and 3*b* illustrate respectively the form of a scanning signal used in driving another known display device and the effect on the voltage of a display element caused by a change in the characteristics of the element's associated non-linear device using this drive scheme.
Figure 3B:
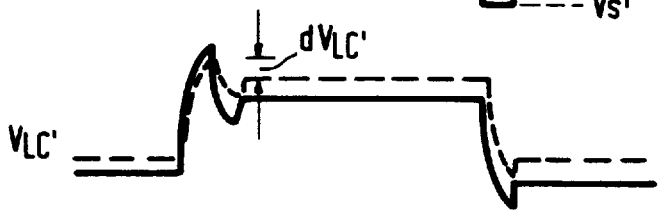

In the case of the row conductors being driven with a five level waveform, then changes in the threshold level of the non-linear devices result in a change in the mean dc level being produced across the display element. FIG. 3*a* illustrates a typical portion of the scanning signal waveform, $V_R$, using this five level drive scheme. In addition to selection and hold signal portions this drive waveform comprises a reset signal, Vr', applied immediately preceding a selection signal, $Vs^{2'}$, so as to discharge the display element prior to selection. FIG. 3*b* is similar to FIG. 2*b* and illustrates the effects on $V_{LC}'$ for non-linear device threshold levels which are comparatively low, as shown by the solid line, or comparatively high, as shown by the dotted line.

When the changes in the non-linear devices' characteristics are as a result of ageing processes during the lifetime of the display device either of the above described changes in the liquid crystal display element voltage can cause problems. The net dc voltage produced in the five level drive scheme particularly can have serious consequences as, if excessive, it leads to problems with image storage and degradation of the LC material.

Figure 4:
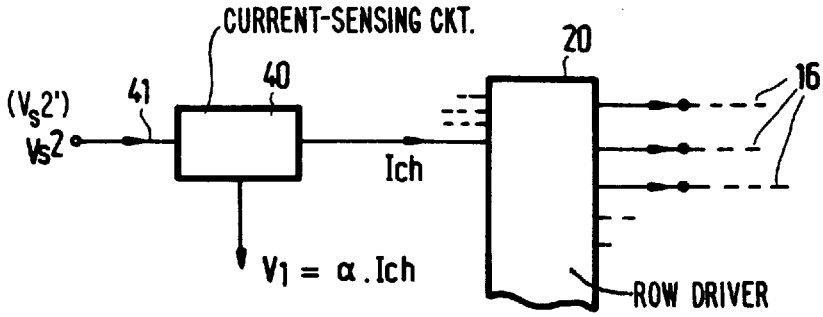
FIG. 4 shows schematically part of a circuit of an embodiment of the display device according to the invention which is operable to compensate for the effects changes in the operating characteristics of non-linear devices associated with the display elements.
Figure 5A:
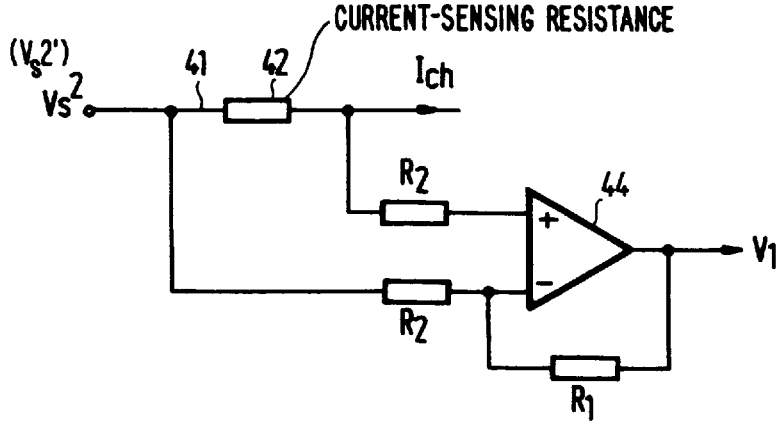
FIGS. 5*a* and 5*b* show respectively two possible forms of sensing circuit used in the compensating circuit.
Figure 5B:
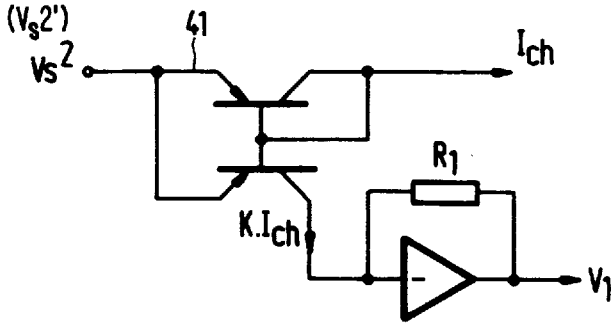

To avoid such problems the display device of FIG. 1 incorporates means for monitoring changes in the characteristics of non-linear devices 15 of the panel 10 and for applying appropriate compensation to the driving of the picture elements in accordance with any such changes. A signal is derived in operation of the display device which is indicative of electrical current flowing to picture elements of the panel 10 during their selection and which is used to adjust drive voltages applied to the picture elements. To this end a current sensing circuit produces a voltage signal indicative of current flowing in a row address conductor which is fed back to a voltage control circuit of the power supply unit 32 and used to determine voltage levels utilised in the scanning signal waveform supplied by the row driver circuit 20. FIG. 4 illustrates schematically the particular arrangement of the sensing circuit used in the display device of FIG. 1. A current sensing circuit 40 is connected in one of the supply lines which supply the current used during selection periods. In the case of the four level row drive scheme this can be either of the lines supplying $Vs^1$ or $Vs^2$ in FIG. 2*a*. In the case of the five level row drive scheme the supply line employed is that which supplies the charging current for the transition from reset to the selection voltage following the reset pulse, i.e. $Vs^{2'}$ in FIG. 3*a*. In the following description it will be assumed for convenience that the sensing circuit 40 is connected in the supply line, here referenced 41, carrying the selection signal voltage $Vs^2$. The circuit 40 produces a voltage signal, $V_1$, which is proportional to current flowing in that line, and thus proportional to the charging current Ich flowing in a row address conductor 16 during the period when the selection signal of the scanning signal is applied to that conductor. FIGS. 5*a* and 5*b* illustrate two possible circuit configurations for the sensing circuit 40. FIG. 5*a* shows a resistor sensing circuit in which a resistance 42 of value r is connected in the supply line 41 and opposite ends of the resistance are connected to the inputs of an amplifier 44 via identical resistances R2 and in which is feedback resistance R1 is connected across the amplifier. In this case $$V_1 = Ich \cdot r \cdot \frac{R1}{R2}$$

FIG. 5*b* shows a current mirror sensing circuit in which an output from a pair of transistors connected base to base in the supply line 41 is fed to an invertor with a feedback resistance R1. In this case, $$V_1 = K.Ich.R1$$

where K is a constant dependent on the transistors.

Referring again to FIGS. 2*b* and 3*b*, it will be appreciated that the current supplied through a row address conductor during its selection period depends on the amplitude of the change in the display element voltage $V_{LC}$, this change being indicated at $dV_{LC}$. In the case of a four level drive scheme (FIG. 2*b*) this is the total change in display element voltage from one field to another. In the case of a five level drive scheme (3*b*) it is the change which occurs as the scanning signal voltage switches from the reset signal level, Vr', to the selection signal level, $Vs^{2'}$. In both cases, the value of ($dV_{LC}'$) depends on the non-linear devices threshold voltage Vth, i.e. the "on" voltage drop across the non-linear device. For example, with a four level drive scheme the following condition applies:

$$dV_{LC}=(Vs^1-Vs^2)-2Vth-2Vcol \quad (1)$$

where Vcol is the peak to peak voltage on the associated column conductor 17 during the selection signal periods.

For a five level drive scheme, $$dV_{LC}'=(Vr'-Vs^{2'})-2Vth-(V^r col-V^s col) \quad (2)$$

where $V^r$col and $V^s$col are the column signals during the reset signal and the following selection signal respectively.

Assuming that the current sensing circuit 40 senses current to R rows of the display panel with N picture elements per row and with each picture element having a capacitance C, and in which the picture elements are operated at a field frequency f, then the average charge current, Icn, supplied to the display panel via the supply line 41 connected to the row driver circuit 20 over a complete field is given by:

$$Ich=0.5.f.N.R.C.dV_{LC} \quad (3)$$

The factor of 0.5 arises because in the five level drive scheme the reset to selection signal transition occurs only in every other field, or if line inversion rather than field inversion is used, only on half the rows in any one field, and in the four level drive scheme sensing is associated with only one of the two selection signals.

The voltage signal $V_1$ varies in accordance with this current Ich and thus, as is apparent from equation (1) in accordance with the threshold voltage, Vth, of the non-linear devices 15. The voltage signal $V_1$ is fed back to the power supply unit where it is used to control the selection signal voltage levels ($Vs^{1'}$) and ($Vs^{2'}$) of the scanning signal and also the reset signal Vr' in the case of the five level drive scheme, (FIGS. 2*a* and 3*a*) in such a manner that ($dV_{LC}'$) is constrained to a substantially constant level for a given data signal voltage despite any changes which may occur in the threshold voltage levels of the non-linear devices.

Figure 6A:
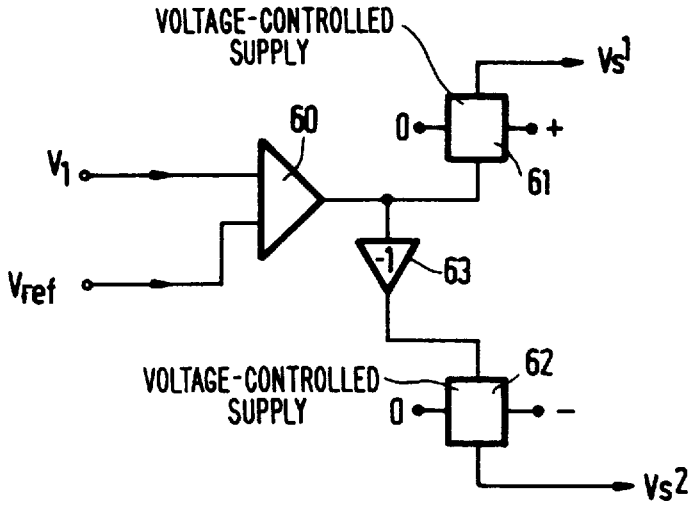
FIGS. 6*a* and 6*b* are schematic circuit diagrams of two forms of voltage adjustment circuits comprising part of the compensating circuit and for use respectively with different drive schemes.
Figure 6B:
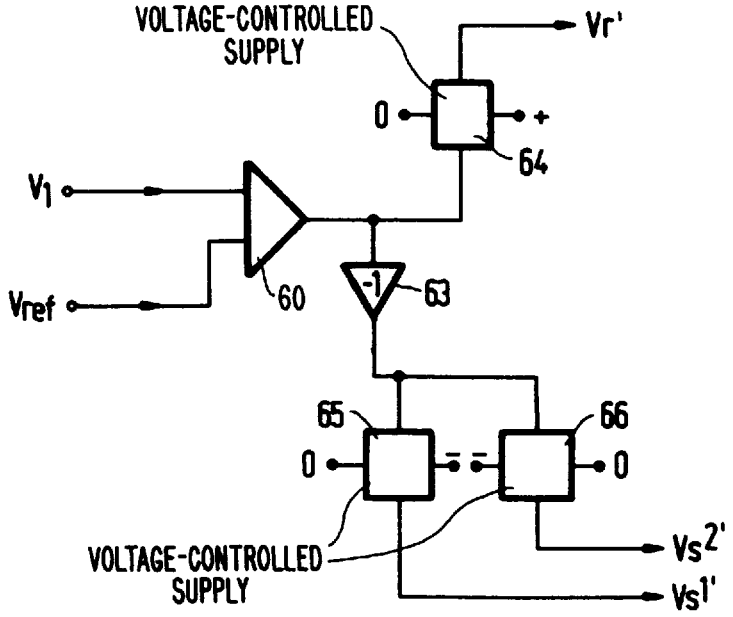

FIGS. 6*a* and 6*b* show schematically a part of the circuit of the power supply unit for powering row driver circuits operating with a four level and a five level row drive scheme respectively. Referring to FIG. 6*a,* the voltage signal $V_1$ is fed to one input of a high gain differential amplifier 60 whose other input is supplied with a fixed reference potential, Vref. The output from the amplifier is supplied to a voltage controlled supply 61 from which the voltage for the $Vs^1$ level is obtained and to a further voltage controlled supply 62, via an inverter 63, from which the voltage for the $Vs^2$ level is obtained. Thus, the voltages produced by the supplies 61 and 62 are varied according to the difference between $V_1$ and Vref. If, therefore, the threshold voltage of the non-linear devices changes, the levels of $Vs^1$ and $Vs^2$ are adjusted so as to provide compensation to the picture element selection signal voltage levels applied when driving the panel 10.

The circuit shown in FIG. 6*b* is similar in many respects. In this case the output from the amplifier 60 is supplied to a voltage controlled supply 64 from which the voltage for the reset pulse signal level, Vr', is obtained and, via the inverter 63, to two further voltage controlled supplies 65 and 66 from which the voltages for the two selection signal levels $Vs^{1'}$ and $Vs^{2'}$ are respectively obtained.

From equations (1), (2) and (3) it is seen that the value of ($dV_{LC}'$), and hence Ich, is dependent to some extent on the column conductor voltages, Vcol, present at the current sensing period and the signal $V_1$ varies in accordance with the average of the column, data, signals present during the sensing period. Any problems which might be caused in view of this can be overcome using one of two different approaches. In the first approach, the voltage applied to the column conductors 17 may be set to a given, fixed value for a certain period in which the sensing circuit 40 is arranged to sense current and adjustment is made to the scanning signal levels with the value of Vref being appropriately selected. This can be achieved simply by arranging that the current sensing/scanning signal adjustment operation is accomplished in a short period, for example over a few field periods, immediately upon the display device being switched on whereby each time the display device is switched on any adjustment to the scanning signal levels necessary as a result of a change in the characteristics of the non-linear devices is effected. To this end a change over switch may be connected in the video data signal supply line 28 from the circuit 25 to the column driver circuit 22 which is operated so as to apply a fixed data signal level to the circuit 22 for a predetermined period corresponding to a number of field periods each time the display device is activated and which then reverts to its normal operating state in which the video data signals are supplied to the circuit 22. Alternatively, one row of picture elements of the display panel 10, for example the top or bottom row, and in practice masked from view, may be arranged to be driven to a given level each time they are addressed and the sensing circuit 40 then arranged so that current sensing is only effected during the period while this row is being driven. For the five level drive scheme the column signal should be held at the appropriate reference level for two row address periods corresponding to the times when both the reset and the subsequent selection signals are applied to the reference row of picture elements. Using this approach it will be understood that any effects caused then by the column voltages are removed and that any changes in the scanning signal levels produced by the circuits of FIGS. 6*a* and 6*b* accordingly will be as a result of a variation in $V_1$ caused by a change in the characteristics of the non-linear devices.

Figure 7:
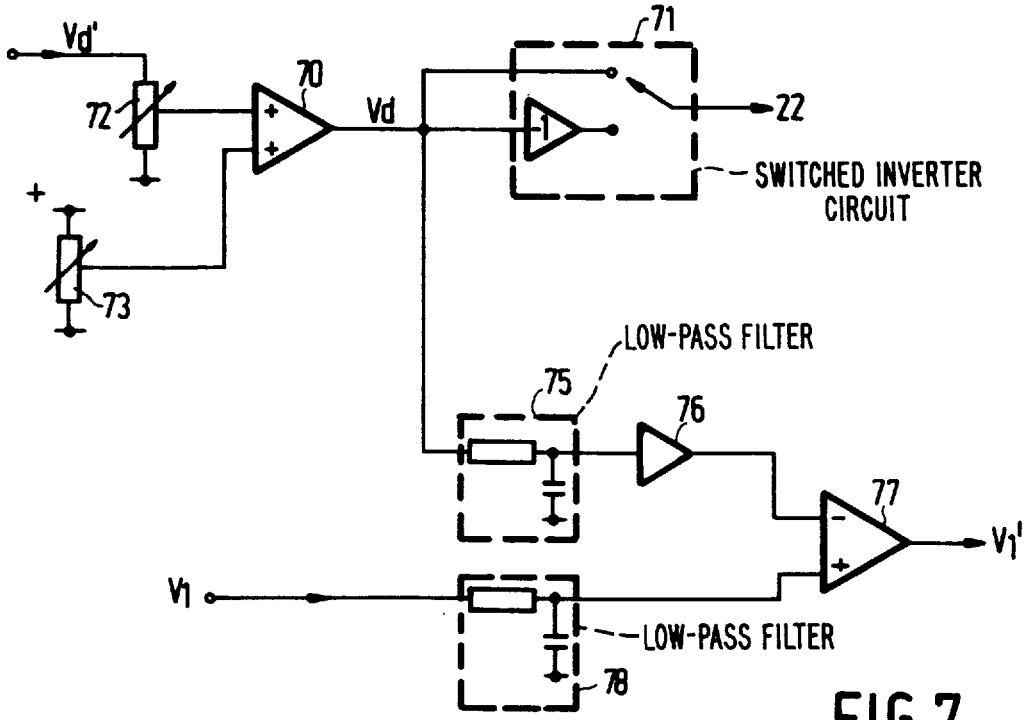
FIG. 7 illustrates parts of the drive circuit and the compensation circuit used in another embodiment of display device according to the present invention.

In the second approach the value of Vcol during the current sensing period is determined and its contribution to the control signal $V_1$ is removed. This can be achieved conveniently by modifying the output, $V_1$, from the sensing circuit 40 according to voltages present on the column conductors 17 and supplying the modified signal, hereafter referred to as $V_1'$, to the input of the voltage control circuit of FIG. 6*a* or 6*b* instead of the signal $V_1$ as originally described. FIG. 7 illustrates schematically a circuit by which such modification can be accomplished in the case of a four level drive scheme. This includes part of the video processing unit 30 of the circuit 25 in which the video data signal Vd is produced at the output of an amplifier 70 for supply to the column driver circuit 22 via a switched inverter circuit 71 which operates to invert the signal applied to the driver circuit 22 after every field, and possibly after every line, in accordance with conventional practice. The video signal Vd is obtained from an initial video signal Vd' which is adjusted for contrast and black level requirements by means of the potentiometers 72 and 73 respectively. The video signal is connected via a low pass filter 75 and an amplifier 76 to one input of a differential amplifier 77. The signal $V_1$ from the sensing circuit 40 is supplied via a low pass filter 78 matched with the filter 75 to the other input of the amplifier 77. The gain of the amplifier 76 is adjusted so as to give at the output of the amplifier 77 a signal $V_1'$ correctly compensated for variations in $V_1$ with video signal level.

It will be appreciated that the functions of the circuits in FIGS. 6 and 7 may be accomplished digitally instead.

Figure 8:
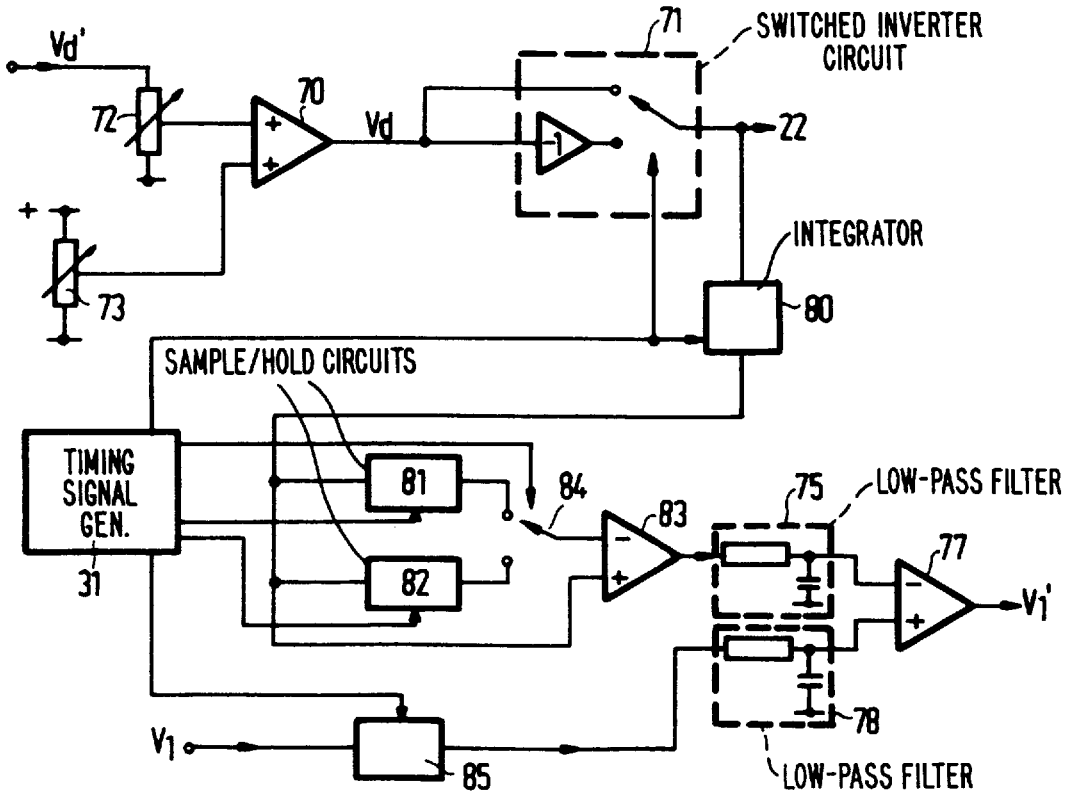
FIG. 8 illustrates a modified form of the circuit of FIG. 7.

Conventional column driver circuits introduce a one-line period delay between the video data signal received and the output to the column conductors 17. If the current in only one, or a few, row conductors 16 is being monitored then the data signals used for correction may not correspond to the column signals applied to the picture elements concerned. FIG. 8 illustrates a modified form of the circuit of FIG. 7 which can be used in these circumstances. In this circuit, the output of the switched inverter circuit 71 is supplied to an integrator 80 whose operation, like that of the circuit 71, is controlled by the timing signal generation unit 31, and whose output is supplied to two sample and hold circuits 81, 82, again controlled by the circuit 31, and to one input of a subtractor circuit 83. The outputs of the circuits 81 and 82 are fed individually via a switch 84 controlled by the circuit 31 to the other input of the subtractor circuit 83. The signal $V_1$ is supplied to an integrator 85 matched to the integrator 80. The output of the integrator 85 is fed via the low pass filter 78 to one input of the amplifier 77 whose other input is connected via the matched low pass filter 75 to the output of the subtractor circuit 83. The integrator 80 averages one line of video data signals. The output of the integrator 80 is stored in the sample and hold circuits 81 and 82 for one line period, alternating every line. The subtractor circuit 83 subtracts the average signal of the previous line (from one of the sample and hold circuits 81,82) from the average signal from the current line so providing a value for $-(V^r col - V^s col)$ referred to in equation (2).

In using this second approach for compensating for the effects of the video data voltages on the column conductors 17 greater freedom is allowed in choosing the number of rows of picture elements to be used in providing corrected scanning signals. The operation of the compensation circuit may be switched intermittently so as to respond to the behaviour of one or a few rows of picture elements or may be continual with the behaviour of all rows of the display panel 10 being taken into account.

With regard to all the above-described embodiments, the sensing circuit 40 may be combined with the row driver circuit 20 to form one, or more, integrated circuits or may instead be incorporated in the power supply unit of the circuit 25.

Although in the above described embodiments, the non-linear devices comprise bidirectional devices, it should be understood that the invention is applicable also to matrix display devices, and their method of operation, of the kind in which non-linear devices comprising unidirectional devices are used, for example as described in EP-A-0299546, whose disclosure is incorporated herein by reference, in which each display element is connected in series with a unidirectional diode element between respective row and column address conductors and also in series with a second unidirectional diode element to a respective reference voltage conductor which is common to the display elements in the same column, and in which a five level scanning signal waveform is applied to the row conductors.

It is envisaged that passive electro-optical media other than liquid crystal material, such as electrochromic materials or electrophoretic suspensions could be used instead.

From reading the present disclosure, various modifications will be apparent to persons skilled in the art. Such modifications may involve other features which are already known in the field of active matrix display devices and which may be used instead of or in addition to features already described herein.

I claim:

1. A matrix display device comprising sets of row and column address conductors, a row and column array of picture elements operable to produce a display, each of which comprises an electro-optic display element connected in series with a two terminal non-linear device exhibiting a threshold characteristic between a row conductor and a column conductor, and picture element drive means connected to the sets of address conductors for applying drive voltages to the picture elements comprising a scanning signal drive circuit for applying selection signals to the conductors of one set and a data signal drive circuit for applying data signals to the conductors of the other set, characterised in that the drive means includes a sensing circuit which is arranged to provide a control signal indicative of electrical current flowing in at least one address conductor of the one set in response to the application of selection signals to that address conductor, and a voltage control circuit to which the control signal is supplied for determining the drive voltages applied by the drive means to the picture elements in accordance with the value of the control signal.

2. A matrix display device according to claim 1, characterised in that the voltage control circuit provides an output which determines the level of the selection signals in accordance with the control signal.

3. A matrix display device according to claim 2, characterised in that the level of the selection signals is adjusted in accordance with the difference between the control signal and a reference level.

4. A matrix display device according to claim 2, characterised in that the scanning signal drive circuit applies a scanning signal waveform which comprises reset signals in addition to the selection signals and in that the output of the voltage control circuit also determines the level of the reset signals.

5. A matrix display device according to claim 2, characterised in that the scanning signal circuit is electrically connected to a supply line to which a potential determining the level of the selection signal is supplied and in that the sensing circuit is arranged to sense electrical current flowing in that supply line.

6. A matrix display device according to claim 1, characterised in that the sensing circuit provides a voltage signal which varies in accordance with electrical current sensed thereby and in that the control signal is obtained by correcting the voltage signal in accordance with the level of data signals applied to address conductors of the other set.

7. A matrix display device according to claim 6, characterised in that the control signal is obtained from a subtractor circuit to which the voltage signal from the sensing circuit and a data signal supplied to the data signal drive circuit are applied.

8. A matrix display device according to claim 7, characterised in that said signals are applied to the substractor circuit respectively via matched low pass filters.

9. A matrix display device according to claim 1, characterised in that the sensing circuit is arranged to provide said control signal at selected periods and in that the data signal drive circuit is operable to supply a predetermined potential level to the address conductors of the other set during said periods.

10. A matrix display device according to claim 9, characterised in that the control signal is indicative of electrical current in an address conductor associated with a row of picture elements to which a predetermined data signal is applied each time a selection signal is applied to that address conductor.

11. A matrix display device according to claim 1, characterised in that the non-linear devices comprise MIMs.

12. A matrix display device according to claim 1, characterised in that the electro-optic display element of each picture element comprises a liquid crystal display element.

13. A method of operating a matrix display device comprising sets of row and column address conductors, a row and column array of picture elements operable to produce a display, each of which comprises an electro-optic display element connected in series with a two terminal non-linear device exhibiting a threshold characteristic between a row conductor and a column conductor, and picture element drive means connected to the sets of address conductors for applying drive voltages to the picture elements comprising a scanning signal drive circuit for applying selection signals to the conductors of one set and a data signal drive circuit for applying data signals to the conductors of the other set, characterised by the steps of deriving a control signal indicative of the electrical current flowing in at least one address conductor of the one set in response to the application of selection signals to that address conductor and controlling the level of the drive voltages applied to the picture elements in accordance with the value of the control signal.

14. A method according to claim 13, characterised in that the level of the selection signals is controlled in accordance with the value of the control signal.

15. A method according to claim 13, characterised in that the step of deriving a control signal comprises generating a voltage signal which varies in accordance with the level of said electrical current and adjusting said voltage signal according to the data signal level.

16. A method according to claim 13, characterised in that the step of controlling the drive voltages applied to the picture elements is carried out periodically in operation of the display device.

* * * * *